US006736701B1

(12) United States Patent
Shue et al.

(10) Patent No.: US 6,736,701 B1
(45) Date of Patent: May 18, 2004

(54) ELIMINATE BROKEN LINE DAMAGE OF COPPER AFTER CMP

(75) Inventors: Shau-Lin Shue, Hsinchu (TW); Ying-Ho Chen, Taipei (TW); Wen-Chih Chiou, Miaoli (TW); Tsu Shih, Hsin-Chu (TW); Syun-Ming Jang, Hsin-Chu (TW)

(73) Assignee: Taiwan Semiconductor Manufacturing Company, Hsin-Chu (TW)

( * ) Notice: Subject to any disclaimer, the term of this patent is extended or adjusted under 35 U.S.C. 154(b) by 287 days.

(21) Appl. No.: 09/989,838

(22) Filed: Nov. 20, 2001

(51) Int. Cl.[7] ..... B24B 1/00
(52) U.S. Cl. ..... 451/8; 451/36; 438/692
(58) Field of Search ..... 451/8, 36, 37, 451/41, 57; 438/691–693

(56) References Cited

U.S. PATENT DOCUMENTS

| | | | | |
|---|---|---|---|---|
| 5,722,877 A | | 3/1998 | Meyer et al. | 451/41 |
| 5,840,629 A | | 11/1998 | Carpio | 438/692 |
| 5,871,390 A | | 2/1999 | Pant et al. | 451/5 |
| 5,893,756 A | | 4/1999 | Berman et al. | 438/692 |
| 5,954,997 A | | 9/1999 | Kaufman et al. | 252/79.1 |
| 5,981,454 A | * | 11/1999 | Small | 510/175 |
| 5,996,594 A | * | 12/1999 | Roy et al. | 134/1.3 |
| 6,156,661 A | * | 12/2000 | Small | 438/692 |
| 6,274,478 B1 | * | 8/2001 | Farkas et al. | 438/626 |
| 6,395,635 B1 | * | 5/2002 | Wang et al. | 438/692 |
| 6,436,302 B1 | * | 8/2002 | Li et al. | 216/38 |
| 6,436,832 B1 | * | 8/2002 | Ma et al. | 438/692 |

FOREIGN PATENT DOCUMENTS

JP 2001156029 A * 6/2001 ..... H01L/21/304

* cited by examiner

*Primary Examiner*—Joseph J. Hail, III
*Assistant Examiner*—David B. Thomas
(74) *Attorney, Agent, or Firm*—George O. Saile; Stephen B. Ackerman

(57) ABSTRACT

A new method is provided for the post-deposition treatment of copper lines. A damascene copper line pattern whereby a TaN barrier layer and a seed layer have been provided is polished. Under the first embodiment of the invention, the deposited copper is polished (Cu CMP), the surface of the wafer is rinsed using a first High Flow DI rinse that contains a TBA inhibitor. The TaN CMP is performed immediately following the first High Flow DI rinse. A second High Flow DI rinse is applied using DI water that contains TBA inhibitor. The required following rinse step is executed immediately after the second High Flow DI rinse has been completed. Under the second embodiment of the invention, the process of CMP has been divided in two distinct steps where the first step is aimed at corrosion elimination and the second step is aimed at elimination of mechanical damage to the polished copper. The processing conditions for the second processing step have been extended and optimized, thereby using a second belt of a CMP apparatus.

20 Claims, 2 Drawing Sheets

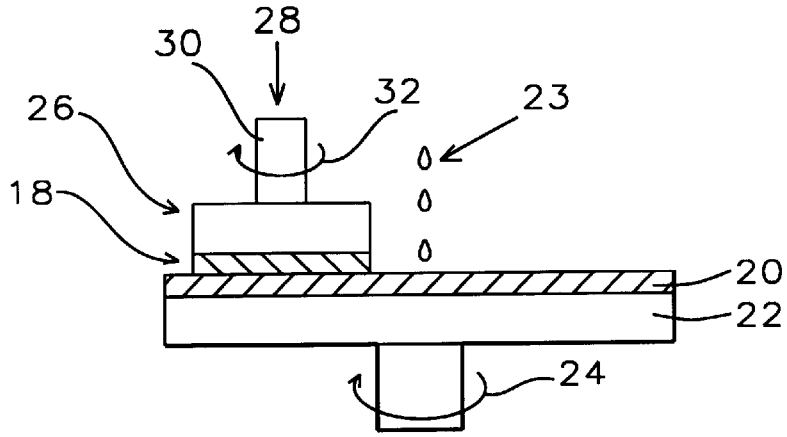
FIG. 1 – Prior Art
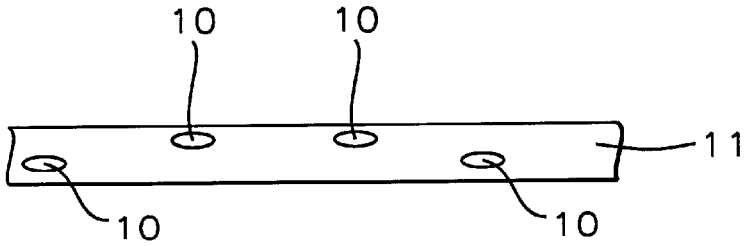
FIG. 2a – Prior Art
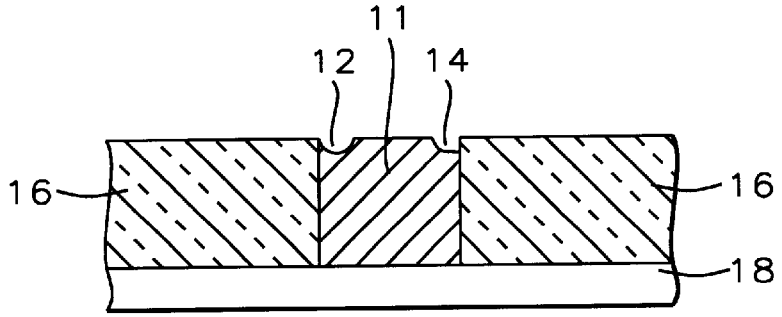
FIG. 2b – Prior Art
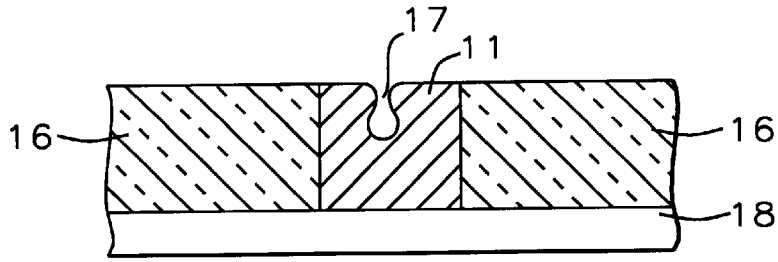
FIG. 2c – Prior Art

ELIMINATE BROKEN LINE DAMAGE OF COPPER AFTER CMP

BACKGROUND OF THE INVENTION (1) Field of the Invention

The invention relates to the fabrication of integrated circuit devices, and more particularly, to a method to prevent damage to copper lines during the process of polishing copper lines.

(2) Description of the Prior Art

The present invention relates to the creation of conductive lines and vias that provide the interconnection of integrated circuits in semiconductor devices and/or the interconnections in a multilayer substrate on which semiconductor device(s) are mounted. The present invention specifically relates to the fabrication of conductive lines and vias by a process known as damascene. Damascene is an interconnection fabrication process in which grooves are formed in an insulating layer and filled with metal to form the conductive lines. Dual damascene is a multi-level interconnection process in which, in-addition to forming the grooves of single damascene, conductive via openings also are formed. Copper damascene wiring is one of the most promising technologies to reduce RC delay as well as to implement the shrinkage of interconnect structures. For this, Chemical Mechanical Polishing (CMP) of inlaid copper is required to form the copper wiring. One of the major problems that is encountered when polishing inlaid copper patterns is the damage that is caused on the copper trench as a consequence of the polishing process. The invention addresses this concern and provides a novel method for damascene trench planarization by CMP processes.

Chemical Mechanical Polishing is a method of polishing materials, such as semiconductor substrates, to a high degree of planarity and uniformity. The process is used to planarize semiconductor slices prior to the fabrication of semiconductor circuitry thereon, and is also used to remove high elevation features created during the fabrication of the microelectronic circuitry on the substrate. One typical chemical mechanical polishing process uses a large polishing pad that is located on a rotating platen against which a substrate is positioned for polishing, and a positioning member which positions and biases the substrate on the rotating polishing pad. Chemical slurry, which may also include abrasive materials, is maintained on the polishing pad to modify the polishing characteristics of the polishing pad in order to enhance the polishing of the substrate.

While copper has become important for the creation of multilevel interconnections, copper lines frequently show damage after CMP and clean. This in turn causes problems with planarization of subsequent layers that are deposited over the copper lines since these layers may now be deposited on a surface of poor planarity. Isolated copper lines or copper lines that are adjacent to open fields are susceptible to damage. While the root causes for these damages are at this time not clearly understood, poor copper gap fill together with subsequent problems of etching and planarization are suspected. Where over-polish is required, the problem of damaged copper lines becomes even more severe.

During the Chemical Mechanical Planarization (CMP) process, semiconductor substrates are rotated, face down, against a polishing pad in the presence of abrasive slurry. Most commonly, the layer to be planarized is an electrical insulating layer overlaying active circuit devices. As the substrate is rotated against the polishing pad, the abrasive force grinds away the surface of the insulating layer. Additionally, chemical compounds within the slurry undergo a chemical reaction with the components of the insulating layer to enhance the rate of removal. By carefully selecting the chemical components of the slurry, the polishing process can be made more selective to one type of material than to another. For example, in the presence of potassium hydroxide, silicon dioxide is removed at a faster rate than silicon nitride. The ability to control the selectivity of a CMP process has led to its increased use in the fabrication of complex integrated circuits.

It is well known in the art that, in the evolution of integrated circuit chips, the process of scaling down feature sizes results in making device performance more heavily dependent on the interconnections between devices.

In addition, the area required to route the interconnect lines becomes large relative to the area occupied by the devices. This normally leads to integrated circuit chips with multilevel interconnect lines. The chips are often mounted on multi-chip modules that contain buried wiring patterns to conduct electrical signals between the various chips. These modules usually contain multiple layers of interconnect metalization separated by alternating layers of an isolating dielectric.

Any conductor material to be used in a multilevel interconnect has to satisfy certain essential requirements such the underlying substrate material, stability (both electrical and mechanical) and ease of processing.

Copper is often preferred due to its low resistivity, high electromigration resistance and stress voiding resistance. Copper unfortunately suffers from high diffusivity in common insulating materials such as silicon oxide and oxygen-containing polymers. For instance, copper tends to diffuse into polyimide during high temperature processing of the polyimide. This causes severe corrosion of the copper and the polyimide due to the copper combining with oxygen in the polyimide. This corrosion may result in loss of adhesion, delamination, voids, and ultimately a catastrophic failure of the component. A copper diffusion barrier is therefore often required.

Copper is typically very difficult to process using RIE technology as a consequence of which a method that uses CMP for copper wire formation offers significant advantages. To polish a buried copper wiring formation at a high polishing rate and without damaging the surface, the copper etch rate must be raised by increasing the amount of the component that is responsible for copper etching that is contained in the polishing slurry. If the component continues to be increased, the etching will occur isotropically whereby buried copper is etched away, causing dishing in the wiring. Thus, it is difficult to form a highly reliable LSI wiring made of copper.

FIG. 1 shows a Prior Art CMP apparatus. A polishing pad 20 is attached to a circular polishing table 22 that rotates in a direction indicated by arrow 24 at a rate in the order of 1 to 100 RPM. A wafer carrier 26 is used to hold wafer 18 facedown against the polishing pad 20. The wafer 18 is held in place by applying a vacuum to the backside of the wafer (not shown). The wafer 18 can also be attached to the wafer carrier 26 by the application of a substrate attachment film (not shown) to the lower surface of the wafer carrier 26. The wafer carrier 26 also rotates as indicated by arrow 32, usually in the same direction as the polishing table 22, at a rate on the order of 1 to 100 RPM. Due to the rotation of the polishing table 22, the wafer 18 traverses a circular polishing path over the polishing pad 20. Slurry 23 is supplied to the surface of the wafer 18 that is being polished. A force 28 is also applied in the downward vertical direction against wafer 18 and presses the wafer 18 against the polishing pad 20 as it is being polished. The force 28 is typically in the order of 0 to 15 pounds per square inch and is applied by means of a shaft 30 that is attached to the back of wafer carrier 26.

A typical CMP process involves the use of a polishing pad made from a synthetic fabric and a polishing slurry, which includes pH-balanced chemicals, such as sodium hydroxide, and silicon dioxide particles.

Abrasive interaction between the wafer and the polishing pad is created by the motion of the wafer against the polishing pad. The pH of the polishing slurry controls the chemical reactions, e.g. the oxidation of the chemicals that comprise an insulating layer of the wafer. The size of the silicon dioxide particles controls the physical abrasion of surface of the wafer.

The polishing pad is typically fabricated from a polyurethane (such as non-fibrous polyurethane, cellular polyurethane or molded polyurethane) and/or a polyester-based material. Pads can for instance be specified as being made of a microporous blown polyurethane material having a planar surface and a Shore D hardness of greater than 35 (a hard pad). Semiconductor polishing pads are commercially available such as models IC1000 or Scuba IV of a woven polyurethane material.

FIGS. 2*a* through 2*c* show three cross-sections of copper depositions and patterns of damage that have been observed for each of these depositions.

FIG. 2*a* shows a planar view of a copper line 11 after line deposition and line planarization. An irregular plurality 10 of surface disruptions is apparent on the surface of the copper line. These disruptions 10 are caused by surface oxidation after line polishing or by line corrosion caused by interaction of the copper with slurry chemicals during the polishing of the copper line.

Experiments have indicated that the line damage 11 that is shown is dependent on and can therefore be influenced by the rate of slurry deposition on the surface that contains the copper lines during CMP. The rate of slurry deposition is defined as the volume, expressed in cubic-centimeter (cc), of slurry deposited during a given time, or as cc/minute.

Increased rate of slurry deposition results in a decrease of copper line surface damages. This experimental observation forms the basis for the invention in that the invention teaches a multi-step slurry deposition during the CMP of the copper lines whereby each step within the multi-step slurry deposition has a unique rate of slurry deposition.

FIG. 2*b* shows another form of copper line damage or irregularity that has been observed at the completion of the CMP of copper line 11. Copper line 11 is deposited on the surface of substrate 18. Area 12 is a hollowing out of the copper surface at the edge of the surface of the copper line 11 where this edge interfaces with the surrounding dielectric 16. This hollowing out has the profile of a semi-circle. Another irregularity is highlighted with 14, this irregularity also occurs on the surface of the copper line 11 where this line interfaces with the surrounding dielectric 16. This irregularity 14 has a sloping profile with the lowest point of the slope being at the sidewall of the opening that was created for the deposition of the copper line 11.

FIG. 2*c* shows yet another irregularity 17 that is typical and has been observed in the surface of the polished copper line 11. This irregularity 17 is typically referred to as a keyhole opening if the irregularity extends over a limited or concentrated section of the surface of the copper line 11. This surface irregularity can however also extend over a larger section of the surface of the copper line 11 and can, in this extension, follow the direction of a deposited copper line 11 over a considerable distance. In this case the irregularity is referred to as a surface seam in the copper line 11.

The process of the invention teaches a new polishing sequence and improved control over such polishing parameters as applied pressure during polishing, wafer carrier speed, slurry flow, belt speed and rinse time.

U.S. Pat. No. 5,893,756 (Berman et al.) teaches a cleaner after CMP.

U.S. Pat. No. 5,840,629 (Carpio) and U.S. Pat. No. 5,954,997 (Kaufman et al. show Cu CMP slurries and processes.

U.S. Pat. No. 5,722,877 (Meyer et al.) and U.S. Pat. No. 5,5,871,390 (Pant et al.) show CMP tools with adjustable belt parameters.

SUMMARY OF THE INVENTION

A principle objective of the invention is to reduce the impact of chemical surface reactions that are incurred between the steps of copper CMP and TaN-barrier CMP.

Another objective of the invention is to reduce the impact of chemical surface reactions that are incurred between the steps of TaN-barrier CMP and cleaning.

Another objective of the invention is to reduce surface abrasion and mechanical surface damage to copper lines during rinse cycles.

Yet another objective of the invention is to shorten the time delay that is required between the steps of copper CMP and TaN-barrier CMP.

Yet another objective of the invention is to shorten the time delay that is required between the steps of TaN-barrier CMP and cleaning.

Yet another objective of the invention is to improve the yield of the copper back-end-of-line (BEOL) process.

Yet another objective of the invention is to improve the reliability of the created copper lines.

In accordance with the objectives of the invention a new method is provided for the post-deposition treatment of copper lines. The invention has two embodiments. The process flow for the process of the first embodiment of the invention starts with the formation of a damascene or dual damascene pattern, a TaN barrier layer is deposited in the created opening overlying the bottom and the sidewalls of the opening. The seed layer is next deposited over the barrier layer, the opening of the damascene or dual damascene structure is filled with copper, the deposited copper is polished (Cu CMP) thereby completing the formation of the metal filled damascene or dual damascene structure. As a first step after Cu CMP, the surface of the wafer is rinsed using a first High Flow DI rinse that contains a TBA inhibitor. As a second step after Cu CMP, the step of TaN CMP is performed immediately following the first High Flow DI rinse whereby the TaN CMP is either time mode or until completion of the TaN CMP. As a third step after Cu CMP, a second High Flow DI rinse is applied using DI water that contains TBA to further clean the surface of the wafer. As a fourth step after Cu CMP, the required following rinse step is executed immediately after the second High Flow DI rinse has been completed. Under the second embodiment of the invention, the process of CMP has been divided in two distinct steps where the first step is aimed at corrosion elimination and the second step is aimed at elimination of mechanical damage to the polished copper. The processing conditions for the second processing step have been extended and optimized, thereby using a second belt of a CMP apparatus.

BRIEF DESCRIPTION OF THE DRAWINGS

FIG. 1 shows a Prior Art wafer polishing apparatus.

FIGS. 2*a* through 2*c* show problems encountered with copper line depositions.

DESCRIPTION OF THE PREFERRED EMBODIMENTS

Typical post-deposition treatment of copper lines comprises the steps of Cu CMP followed by barrier layer/TaN CMP followed by surface cleaning. The manner in which these steps are performed, the delay that is incurred between the successive steps of polish and clean and the number and sequence in which the cleaning steps are performed are critically important in obtaining the desired results and in affecting the objectives of the invention that have previously been stated. During the process of polishing a number of polishing related parameters also have a significant impact on the results that are obtained. These parameters are the force (in psi) that is applied by the polishing pad to the surface that is being polished, the relative rotational speed (in rpm) between the polishing pad and the surface that is being polished determined by the polishing head rotational speed and the forward speed of transportation (in fpm) of the belt on which the wafers that are being polished are being transported, the slurry composition and the slurry flow (in sccm) that is applied during the process of polishing, the type of rinse (typically DI water) that is applied, the time duration (in seconds) of the applied rinse.

Figure 3:
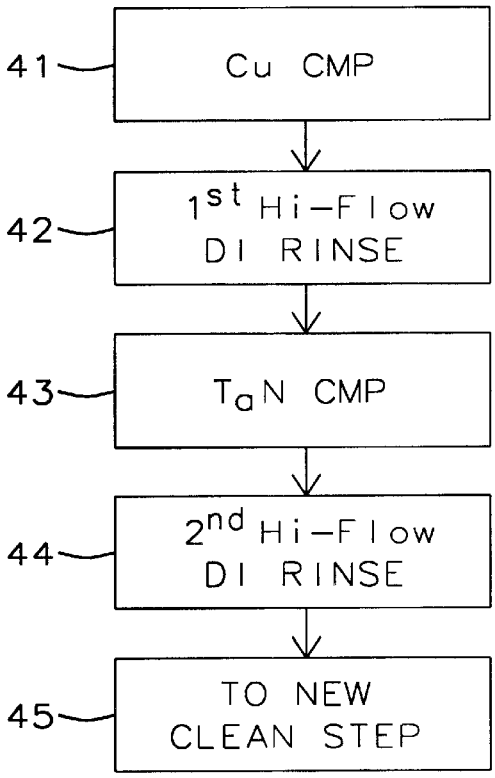
FIG. 3 shows a flow diagram of the processing steps of the first embodiment of the invention.

Referring now specifically to FIG. 3, there is shown a flow diagram of the process steps of the first embodiment of the invention. For the purpose of these processing steps, it is assumed that a pattern of damascene or dual damascene copper lines has been created in a semiconductor surface, typically the surface of a monocrystalline silicon substrate. The copper lines have been provided with a barrier layer of TaN and a seed layer. This pattern of copper lines has been filled with a blanket deposition of copper. The objective of the first embodiment of the invention is to polish the copper surface of the damascene or dual damascene interconnect lines while achieving the previously stated objectives of the invention.

FIG. 3, step 41 shows the step of copper CMP that is first applied to the surface of the blanket layer of deposited copper. This process of CMP is continued to the point where the copper is essentially removed from the surface of the substrate leaving the damascene or dual damascene lines filled with copper. The first processing step of the first embodiment of the invention is a step of copper slurry polishing; the copper slurry that is created during this step must be removed from the surface of the substrate. This removal is achieved by applying, FIG. 3, step 42, a first High Flow DI rinse with a TBA inhibitor, this rinse cleans the surface of the wafer by removing the copper slurry.

FIG. 3, step 43 indicated that, after the first High Flow DI rinse has been completed, the TaN CMP is performed immediately following the completion of the first DI rinse. It is important that there is no time delay between the two steps of first DI rinse and the start of the TaN CMP. This statement has been derived and confirmed based on a significant number of experiments, whereby the theoretical understanding of the exact reasons as to why better results are obtained in this manner is not clear. It has been suggested that by not allowing time delay between these two steps, the molecular environment that is important to achieving good polishing and cleaning results remains in a state of agitation thereby not allowing any accumulation of residue on the surface of the substrate. The TaN CMP proceeds until either endpoint detection or can be timed.

FIG. 3, step 44 is the step of second High flow DI rinse using a TBA inhibitor to clean the surface of the substrate.

After this second DI water rinse has been completed, the wafer is as soon as possible further processed and advanced to the next and conventional step of wafer clean, FIG. 3, step 45.

Figure 4:
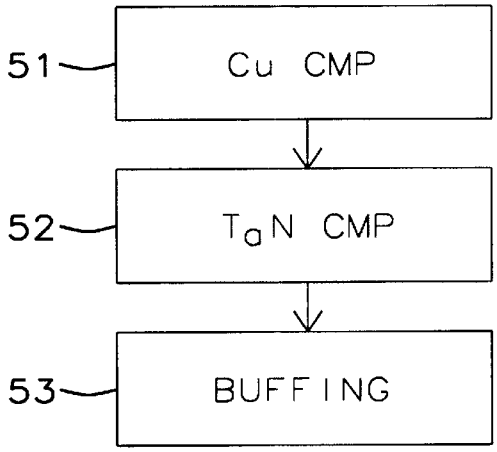
FIG. 4 shows a flow diagram of the processing steps of the second embodiment of the invention.

Referring now specifically to FIG. 4, there are shown the processing steps that are performed under the second embodiment of the invention. For the purpose of these processing steps, it is assumed that a pattern of damascene or dual damascene copper lines has been created in a semiconductor surface, typically the surface of a monocrystalline silicon substrate. The copper lines have been provided with a barrier layer of TaN and a seed layer. This pattern of copper lines has been filled with a blanket deposition of copper. The second embodiment of the invention applies two different polishing belts whereby the first belt is essentially used to perform a copper slurry based polish that is aimed at eliminating copper corrosion while the second belt is essentially aimed at performing a TaN polish thereby eliminating damage (such as broken copper lines) to the surface of the copper lines. It is key to the success of the method of the invention that the processing parameters that are applied during the TaN CMP have been experimentally determined and must be strictly controlled. It must be realized that the conventional apparatus for polishing semiconductor surfaces comprises a belt that transport the wafers with the exposed, to be polished surface of the wafer facing upwards. Above and aligned with this transportation belt is an arrangement of rotating polishing heads onto which polishing pads are mounted. The rotating polishing pads are brought into contact with the surface that is to be polished while the substrate continues to proceed in the direction into which it is being transported.

FIG. 4, step 51 indicates the copper CMP. This processing is performed using the first belt of a CMP apparatus, the processing conditions for this CMP are as follows:

- downforce applied to polishing table: between 3 psi and 6 psi whereby no significant improvement was observed in changing the applied downward pressure between these two values, and
- slurry flow: between 200 sccm and 400 sccm whereby no significant improvement was observed in changing the slurry flow between these two values.

FIG. 4, step 52, indicates the TaN CMP that is performed using a second belt of the CMP apparatus. This second step of TaN CMP has experimentally been determined as being critical to the success of achieving the objectives of the invention, for this reason this step has been studied intensely and precise processing parameters for this TaN CMP have been derived.

These processing parameters, the range of values that have been applied and the results that have been experimentally observed are indicated below. Where the results indicate improvements these improvement relate to the observed and confirmed elimination of irregularities in the surfaces of the copper lines that are polished under this process. As follows:

downforce applied to polishing table: between 2 psi and 3 psi and 4 psi, whereby lower downforce resulted in significant improvements head speed: between 5 rpm and 10 m rpm and 20 rpm, whereby lower head speed resulted in significant improvements belt speed: between 75 feet-per-minute (fpm) and 200 fpm and 400 fpm, whereby no significant improvements were observed when varying the belt speed slurry flow: between 200 sccm and 300 sccm and 400 sccm, whereby higher slurry resulted in improvements of interrupted copper surfaces but whereby the variation in slurry flow did not to appear a major factor in gaining improvements DIW rinse time: between 0 seconds and 10 seconds and 30 seconds and 60 seconds, whereby DIW rinse time played a key role in achieving significant improvements with the longer DIW rinse time resulting in the maximum amount of improvement, and benzotriazole (BTA) concentration for rinse: between 0.1 wt % and 0.2 wt %.

To summarize the above findings, improvements in reducing copper damage can be achieved by:

lower down force lower head rotational speed higher TaN slurry flow longer DIW rinse time adding BTA to DIW rinse, and can dilute TaN slurry concentration to save in cost of TaN slurry.

To accommodate the requirement of the DIW spray and the longer rinse time after the TaN polishing operation, an additional DIW nozzle has been installed serving the second belt.

FIG. 4, step 53 indicates that the substrate is further processed by buffing, this operation has also been investigated for further improvements of the surface quality of the copper lines but no significant results have been obtained from this investigation.

To summarize the results that have been obtained under the two embodiments of the invention:

the first embodiment of the invention teaches that, by following a quick and uninterrupted sequence of polishing and cleaning steps, the copper surface of damascene copper lines can be significantly improved, and the second embodiment of the invention teaches that, by performing the TaN CMP on a separate belt and by closely controlling the processing parameters of this TaN CMP, significant improvements can be made in the surface of the polished copper lines.

Although the invention has been described and illustrated with reference to specific illustrative embodiments thereof, it is not intended that the invention be limited to those illustrative embodiments. Those skilled in the art will recognize that variations and modifications can be made without departing from the spirit of the invention. It is therefore intended to include within the invention all such variations and modifications which fall within the scope of the appended claims and equivalents thereof.

What is claimed is:

1. A method of chemical mechanical polishing of a substrate containing metal damascene or dual damascene lines, comprising:

providing a semiconductor substrate having a surface, said substrate having been provided with one or more damascene or dual damascene metal interconnect lines, said metal interconnect lines being exposed;

performing a metal CMP of said substrate, thereby polishing said metal interconnect lines;

performing a first high-flow DI rinse of said surface of said substrate;

performing a TaN CMP of said surface of said substrate;

performing a second high-flow DI rinse of said surface of said substrate; and continue processing said substrate by routing said substrate to a next step of cleaning.

2. The method of claim 1, whereby said performing a metal CMP of said substrate is an end-point detect polish, said metal CMP being completed at a time that said metal is about removed from said substrate.

3. The method of claim 1, whereby said performing a first high-flow DI rinse of said surface is performing a DIW rinse, whereby a TBA inhibitor has been added to a DIW rinsing agent, said first high-flow DI rinse being performed immediately after completion of said metal CMP of said substrate.

4. The method of claim 1, wherein said performing a TaN CMP of said surface of said substrate is performed immediately after completion of said first high-flow DI rinse, whereby said TaN CMP proceeds until either end-point detection or is time mode completed.

5. The method of claim 1, whereby said performing a second high-flow DI rinse of said surface of said substrate is performing a DIW rinse, whereby a TBA inhibitor has been added to the DIW rinsing agent, said second high-flow DI rinse being performed immediately after completion of said TaN CMP of the surface of said substrate.

6. The method of claim 1, wherein said continued processing of said substrate by routing said substrate to a next step of cleaning is performed immediately after completion of said second high-flow DI rinse.

7. The method of claim 1, wherein said metal is copper.

8. The method of claim 7 wherein said copper comprises at least one underlayer selected from the group comprising titanium, titanium nitride, titanium tungsten, tantalum and derivatives thereof.

9. A method of chemical mechanical polishing of a substrate containing metal damascene or dual damascene lines, comprising:

providing a semiconductor substrate, said semiconductor substrate having been provided with one or more damascene or dual damascene metal interconnect lines, said metal interconnect lines being exposed;

performing a first polishing operation of said substrate, thereby polishing said metal interconnect lines;

performing a second polishing operation of said substrate, said second polishing operation comprising applying a DIW rinse having a benzotriazole (BTA) concentration, thereby polishing said metal interconnect lines; and buffing of said substrate.

10. The method of claim 9, wherein said first polishing operation is performed using a first belt of a polishing apparatus, whereby a downforce is applied to a polishing table of between 3 psi and 6 psi, whereby furthermore a slurry flow of between 200 sccm and 400 sccm is provided.

11. The method of claim 9, wherein said second polishing operation is performed using a second belt of a polishing apparatus, whereby an extended DIW rinse time is applied.

12. The method of claim 11, whereby said extended DIW rinse time is between about 60 and 100 seconds.

13. The method of claim 9, wherein said second polishing operation is performed using a second belt of a polishing apparatus, whereby furthermore polishing conditions are adjusted to provide lower down force concurrent with lower head rotational speed concurrent with higher TaN slurry flow concurrent with longer DIW rinse time.

14. The method of claim 13, wherein said down force is between about 2 and 4 psi.

15. The method of claim 13, wherein said head rotational speed is between about 5 and 20 rpm.

16. The method of claim 13, wherein said TaN slurry flow is between about 200 and 400 sccm.

17. The method of claim 13, wherein said DIW rinse time is between about 0 and 60 seconds.

18. The method of claim 13, wherein said TaN slurry is diluted, thereby reducing operational cost of said TaN slurry.

19. The method of claim 9 wherein said metal is copper.

20. The method of claim 19, wherein said copper comprises at least one underlayer selected from the group comprising titanium, titanium nitride, titanium tungsten, tantalum and derivatives thereof.

* * * * *